United States Patent [19]

Lu

[11] Patent Number: 4,670,930

[45] Date of Patent: Jun. 9, 1987

[54] CLEANING GLOVES

[76] Inventor: Po-Ming Lu, 4-3, Tien Shui Rd., Taipei, Taiwan

[21] Appl. No.: 656,604

[22] Filed: Oct. 2, 1984

[51] Int. Cl.[4] ..... A47L 13/18; A47L 25/08

[52] U.S. Cl. ..... 15/118; 15/227; 2/158

[58] Field of Search ..... 15/227, 104 A, 118, 15/209 R, 210 R, 172; 2/158, 159, 167

[56] References Cited

U.S. PATENT DOCUMENTS 1,782,502 11/1930 Crane ..... 15/227

2,717,437 9/1955 Mestral ..... 15/209 R 3,421,171 1/1969 Tsuruzawa ..... 15/172

*Primary Examiner*—Edward L. Roberts

[57] ABSTRACT

A cleaning glove is configured into a pocket shape and has an opening for receiving the user's hand. The opening is smaller than the pocket body, so as to prevent the user's hand from slipping out of the glove. The glove has outer front and back side surfaces which are made from different kinds of material, so as to clean different dirty surfaces. At least one of the outer side surfaces has an elastic, uniform directional, slant angled brush or bristles for cleaning textured surfaces.

1 Claim, 3 Drawing Figures

CLEANING GLOVES

FIELD OF THE INVENTION

This invention provides a fast cleaning glove for the cleaning of soiled surfaces, especially when dirty surfaces are comprised of glasses, metals, and textures.

BACKGROUND OF THE INVENTION

Generally, when cars are to be cleaned, especially the interior surfaces of the car, it would be desirable to have a handy cleaning tool to do the job. For cleaning surfaces of glasses, metals, or plastic items, wiping clothes are required. For cleaning dust particles which are adhered on a seat cover having a textured surface (such as mohair, cotton, etc.), brushes are required, but either wiping clothes or brushes need larger storage spaces.

SUMMARY OF THE INVENTION

Cleaning gloves provided by this invention are easily worn on the user's hand; the front and back sides of the glove are made from different materials to serve various purposes, and their special features are stated as follows:

(1) The shape of the cleaning gloves of this invention is substantially flat, rectangular in plan outline, and they are easy to store and easy to use.

(2) They can be easily worn on the user's hand and become an integral part thereof to do various cleaning tasks, such as wipe, rub, and brush etc.; therefore, the gloves are easy and convenient to use.

(3) Their front and back sides are made from different materials. When the front side of the glove is used, the back side thereof constitutes an integral part of the whole glove; therefore, each side of the glove, in addition to providing the respective required cleaning function, also maintains the structural integrity of the whole glove. In other words, if a single side is used to serve a respective cleaning purpose, the other side should be provided with certain fixing devices so that the front side thereof will be fixed on the user's palm, such as a fixing belt etc. In this invention, however, such fixing devices are not required.

(4) The products made in accordance with this invention are easy to manufacture, production costs are very low, and a large storage space is not required. Accordingly, a customer may afford to buy several gloves at one time for subsequent use in cleaning different dirty surfaces, according to the type or extent of the surface. For these reasons, the cleaning glove of the present invention is simple, convenient, and has practical features.

The purpose of the invention is to provide a cleaning glove to serve various cleaning purposes. In order to achieve this objective, the cleaning glove is configured into a substantially envelope shape, such that the glove may be worn on the user's hand. The glove has two surfaces, consisting of a front side surface and a back side surface. The front side surface of the glove is made of a hairy material to be used for the cleaning of glass, metal, or plastic and similar surfaces through the usual wiping or rubbing process. The back side surface of the glove is made from an elastic (uniform directional) brush or bristles. It is used for easily brushing off dirt particles which accumulate in crevices or are otherwise adhered to textured surfaces. The features of this invention provide simplicity, convenience, and practicality.

DESCRIPTION OF THE PREFERRED EMBODIMENT

Figure 1:
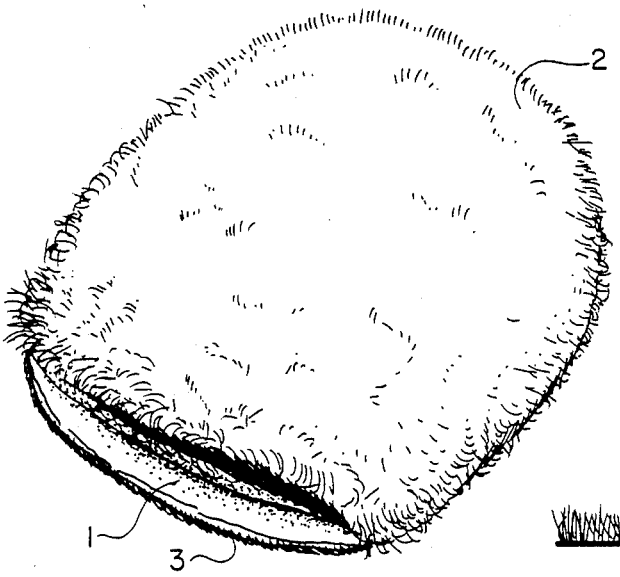
FIG. 1 is a front side perspective of a preferred embodiment of the cleaning glove of this invention, showing the opening in the glove for the user's hand, and further showing the hairy cleaning cloth on the front side of the glove.
Figure 1A:
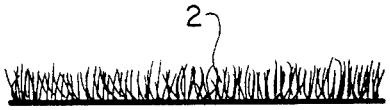

The cleaning glove of this invention generally has an envelope-type configuration or body intended to be worn on the user's hand. The outer surface of this envelope-type of body is divided into two parts, consisting of a front side surface and a back side surface. These side surfaces are made from different kinds of material.

As shown in the drawings, the glove of this invention has a pocket shaped structure. It has an opening 1 for receiving the user's hand. The opening is slightly smaller than the pocket-shaped body of the glove. The purpose is to keep the user's hand inside of the glove, preventing the hand from easily slipping out of the glove, and easily facilitating the cleaning work to be done. As shown in the drawings, the glove is substantially flat and has a substantially rectangular plan outline.

As shown in FIG. 1, the front side surface 2 of the pocket-shaped body is made from a hairy cloth; this surface 2 provides an easy wiping and rubbing function.

Figure 2:
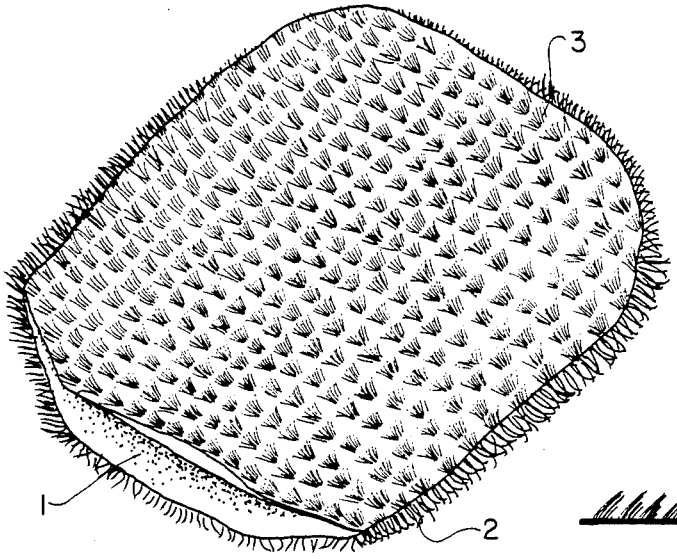
FIG. 2 is a back side perspective of the FIG. 1 embodiment of this invention, showing the opening in the glove for the user's hand, and further showing the brushing cloth on the back side of the glove.
Figure 2A:
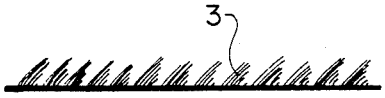
Figure 3:
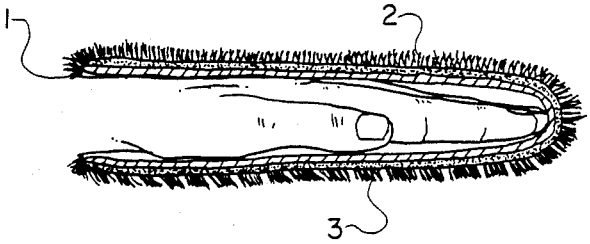
FIG. 3 is a longitudinal section of the FIG. 1 embodiment of this invention, showing the hairy cleaning cloth on top, the brushing cloth on the bottom, and the opening in the glove.

As shown in FIG. 2, the other or back side surface 3 of the pocket-shaped body is made from a brushing cloth. This brushing cloth has an elastic, uniform directional, slant angled brushes or bristle. The materials for this brush may, for example, consist of nylon, or other plastic materials which are readily available.

The seam between the front and back side surfaces of the cleaning glove of this invention is located at the outer edge of the respective front and back side surfaces. Accordingly, the cleaning glove of this invention looks like a flat piece and may be folded together for easy storage. During utilization, either side surface of the cleaning glove of this invention can be worn on the user's palm and, therefore, it is easy to use the product made in accordance with this invention.

I claim:

1. A glove adapted for cleaning various components and materials, especially the metal, glass and plastic components and the textured upholstery used in motor vehicles, comprising a single unitary pocket-shaped substantially-flat body having a substantially rectangular plan outline and including a front side and a back side jointed together by an outer seam, the front and backsides defining therebetween a single interior within the glove, wherein the interior of the glove is devoid of stitching, the glove further including an opening through which the interior of the glove is accessible to a user's hand, the opening being smaller than the interior of the glove, thereby preventing the user's hand from slipping out of the glove, wherein the single front side of the glove is provided with a substantially hairy cloth and is intended for cleaning metal, glass or plastic surfaces, and wherein the back side of the glove is provided with a plurality of slanted bristles and is intended for cleaning textured surfaces.

* * * * *